US008277336B2

(12) United States Patent
Hirano

(10) Patent No.: US 8,277,336 B2
(45) Date of Patent: Oct. 2, 2012

(54) GOLF CLUB HEAD AND METHOD FOR MANUFACTURING THE SAME

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 229 days.

(21) Appl. No.: 12/366,303

(22) Filed: Feb. 5, 2009

(65) Prior Publication Data

US 2009/0275425 A1 Nov. 5, 2009

(30) Foreign Application Priority Data

May 1, 2008 (JP) ..... 2008-119904

(51) Int. Cl.
*A63B 53/00* (2006.01)

(52) U.S. Cl. ..... 473/345; 473/349

(58) Field of Classification Search ..... 473/345
See application file for complete search history.

(56) References Cited

U.S. PATENT DOCUMENTS

| | | | | |
|---|---|---|---|---|
| 6,776,726 | B2 * | 8/2004 | Sano | 473/330 |
| 6,832,961 | B2 * | 12/2004 | Sano | 473/324 |
| 7,601,078 | B2 * | 10/2009 | Mergy et al. | 473/345 |
| 7,690,098 | B2 * | 4/2010 | Chen | 29/557 |
| 2002/0142861 | A1 * | 10/2002 | Helmstetter et al. | 473/342 |
| 2003/0008726 | A1 * | 1/2003 | Sano | 473/345 |
| 2004/0147343 | A1 * | 7/2004 | Billings et al. | 473/349 |
| 2007/0270236 | A1 * | 11/2007 | Hirano | 473/345 |
| 2008/0004133 | A1 * | 1/2008 | Schweigert | 473/342 |
| 2008/0039227 | A1 * | 2/2008 | Schweigert et al. | 473/329 |
| 2008/0102985 | A1 * | 5/2008 | Chen | 473/345 |
| 2008/0125244 | A1 * | 5/2008 | Meyer et al. | 473/332 |
| 2008/0214323 | A1 * | 9/2008 | Chen | 473/349 |
| 2008/0283162 | A1 * | 11/2008 | Chiang | 148/671 |

FOREIGN PATENT DOCUMENTS

| | | | |
|---|---|---|---|
| JP | 10-155943 A | | 6/1998 |
| JP | 2002165906 A | * | 6/2002 |
| JP | 2003265658 | * | 9/2003 |

OTHER PUBLICATIONS

Setogawa et al. , Jun. 2002, JP 2002-165906A, Industrial Property Digital Library, Machine translation Japanese to English.*
Setogawa et al., Jun. 2002, JP 2002-165906A, Industrial Property Digital Library, Machine Translation Japanese to English.*

* cited by examiner

*Primary Examiner* — Gene Kim
*Assistant Examiner* — Matthew B Stanczak
(74) *Attorney, Agent, or Firm* — Birch, Stewart, Kolasch & Birch, LLP

(57) ABSTRACT

A method for manufacturing a golf club head having a hollow structure composed of a main body-member and a metal face member welded thereto, comprises the steps of: (a) preparing a rolled material having a constant thickness; (b) cutting out a face member part or blank from the rolled material; (c) making the face member by forming the turnback through press working on the face member part; and (d) reducing the thickness of a corresponding-to-turnback region by machining prior to the step (c), wherein the corresponding-to-turnback region is a region of the cutout face member part corresponding to the turnback, or a region of the rolled material corresponding to the turnback.

12 Claims, 10 Drawing Sheets

E1 section

GOLF CLUB HEAD AND METHOD FOR MANUFACTURING THE SAME

BACKGROUND OF THE INVENTION

The present invention relates to a golf club head and a manufacturing method therefor, more particularly to a face member integrally including a face-plate and a turnback and a manufacturing method therefor.

Golf club heads (H2) having a hollow structure, which is as shown in FIGS. 18 and 19 composed of a metal main body-member (m2) provided with a front opening, and a face member (f2) provided with a turnback (q) welded to the main body-member (m2), have been disclosed in Japanese Patent Application Publication No. JP-A-10-155943, wherein the face member (f2) is formed by cutting out a metal plate into a specific shape, and the cutout metal plate having a constant thickness is subjected to press working in order to form the turnback. Then, a thickness-reduced part (g) is formed around the face portion by machining after the press working.

On the other hand, in order to provide sufficient durability for the club face, it is desirable that the face member has a sufficient thickness. This however, decreases the coefficient of restitution, therefore, in the above-mentioned prior art, the thickness-reduced part (g) which can compensate for the decrease is formed.

In the case of a relatively thick metal plate especially titanium plate, although the turnback can be formed by press working, in a practical sense, it is difficult to form the turnback by one press operation, and a plurality of press operations are required to form the turnback to prevent it from being broken or cracked. Thus, the production efficiency and cost are not good. Further, there is room for improvement in the coefficient of restitution to increase the carry distance.

SUMMARY OF THE INVENTION

It is therefore, an object of the present invention to provide a method for manufacturing a golf club head and a hollow golf club head, in which the turnback can be formed readily by press working without being damaged, and it becomes possible to improve the rebound performance of the head.

According to one aspect of the present invention, a method for manufacturing a golf club head is provided, wherein the head has a hollow structure composed of a main body-member and a metal face member welded to the main body-member, and the metal face member integrally includes a face-plate forming at least part of a club face, and a turnback extending backward from at least part of the edge of the club face. The method comprises:

step (a) of preparing a rolled material having a constant thickness;

step (b) of cutting out a face member part from the rolled material;

step (c) of making the face member by forming the turnback through press working on the face member part; and step (d) of reducing the thickness of a corresponding-to-turnback region by machining prior to the step (c), wherein the corresponding-to-turnback region is a region of the cutout face member part corresponding to the turnback, or a region of the rolled material corresponding to the turnback.

According to another aspect of the present invention, a golf club head is provided. The head has a hollow structure composed of a main body-member provided with a front opening, and a face member closing the front opening, wherein the face member integrally includes a face-plate forming a club face for striking a ball, and a turnback formed around the face plate, the turnback extends backward from the edge of the club face and has a rear edge welded to the main body-member, the face-plate comprises a central thick part and a thinner peripheral part therearound, the thickness of the face member is gradually decreased from the central thick part to the turnback.

Definition

In this specification, positions, directions, sizes and the like relating to the club head refer to those under a standard state of the club head unless otherwise noted.

The standard state of the club head 1 is such that the club head is set on a horizontal plane HP so that the axis of the club shaft (not shown) is inclined at the lie angle (alpha) while keeping the axis on a vertical plane, and the club face 2 forms its loft angle with respect to the horizontal plane HP. Incidentally, in the case of the club head alone, the center line of the shaft inserting hole 7*a* can be used instead of the axis of the club shaft.

Sweet spot SS is defined as the point of intersection between the club face 2 and a straight line drawn perpendicularly to the club face 2 passing the center of gravity G of the head.

Front-back direction is defined as a direction parallel with the above-mentioned straight line perpendicularly to the club face 2 projected on the horizontal plane HP.

Toe-heel direction is defined as a direction parallel with the horizontal plane HP and perpendicular to the front-back direction.

Club face Edge: If the edge (2*a*, 2*b*, 2*c* and 2*d*) of the club face 2 is unclear due to smooth change in the curvature, a virtual edge line which is defined, based on the curvature change is used instead as follows. As shown in FIGS. 16 and 17, in each cutting plane E1, E2 - - - including the sweet spot SS and the center G of gravity of the head, a point Pe at which the radius (r) of curvature of the profile line Lf of the face portion first becomes under 200 mm in the course from the center SS to the periphery of the club face is determined. Then, the virtual edge line is defined as a locus of the points Pe.

DESCRIPTION OF THE PREFERRED EMBODIMENTS

The present invention can be applied to various types of golf club heads such as iron-type, utility-type and patter-type, but it is suitably applied to wood-type hollow golf heads. Therefore, taking a wood-type hollow golf head as an example, embodiments of the present invention will now be described in detail in conjunction with accompanying drawings.

Figure 1:
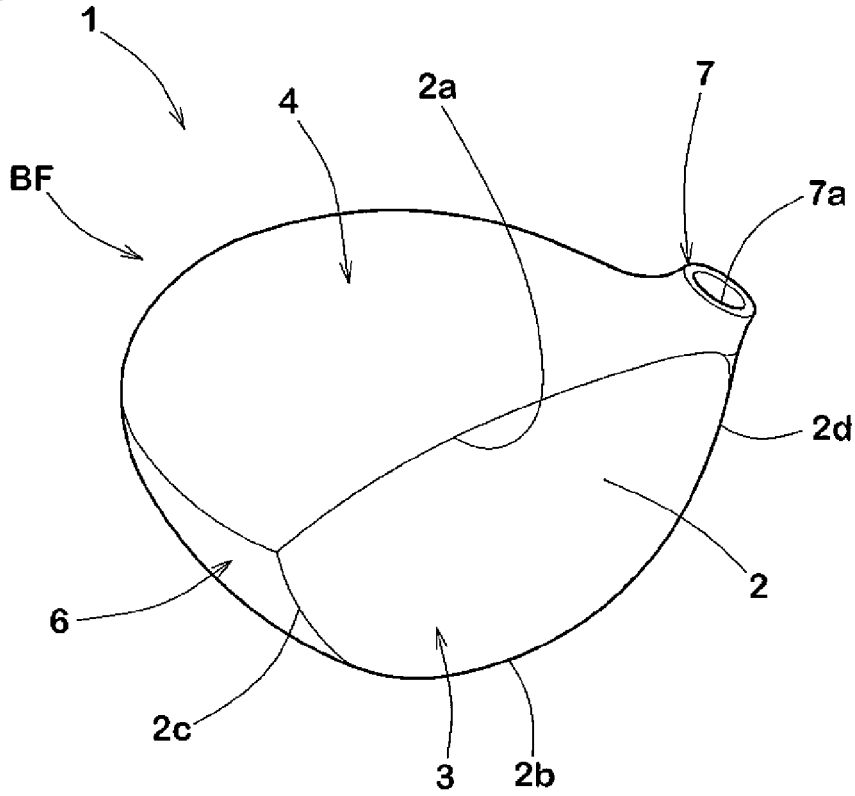
FIG. 1 is a perspective view of a golf club head according to the present invention.
Figure 2:
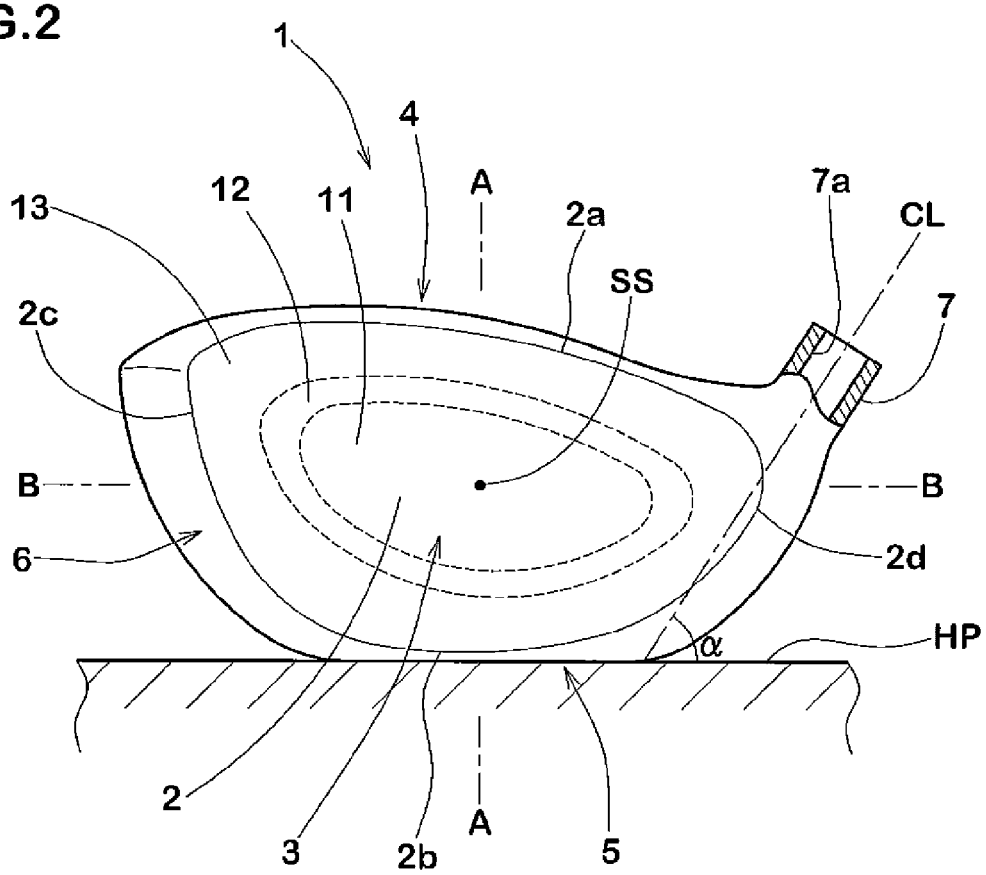
FIG. 2 is a front view thereof.

The club head 1 in this embodiment is a wood-type hollow metal head such as driver (#1) and fairway wood as shown in FIGS. 1 and 2.

In order to increase the moment of inertia to improve the directionality of the hit ball, the club head 1 preferably has a volume of not less than 400 cc, more preferably not less than 420 cc, still more preferably not less than 430 cc. But, in order to avoid unnecessary increase in the club weight and to comply with golf rules, the volume is set to be not more than 470 cc, preferably not more than 460 cc.

The weight of the club head 1 is preferably set in a range of from 180 to 210 grams in view of the swing balance and easiness of swing.

The club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hose 1 portion 7 at the heel side end of the crown to be attached to an end of a club shaft (not shown) inserted into the shaft inserting hole 7*a*. Thus, the club head 1 is provided with a hollow (i) and a shell structure with the thin wall.

According to the manufacturing method of the present invention, a metal face member 1B is fixed to a main body-member 1A by means of welding.

The face member 1B integrally has a face-plate 8 forming at least part of the club face 2, and a turnback 9 extending backward from at least part of the edge (2*a*-2*d*) of the club face 2.

The face member 1B is made of a metal material, for example, stainless steel, maraging steel, titanium alloy and the like. Titanium alloys having a large specific tensile strength such as alpha titanium alloys and alpha-beta titanium alloys can be preferably used. Especially, alpha-beta titanium alloys are preferred. As for the alpha titanium alloy, Ti-5Al-2.5Sn can be used for example. As for the alpha-beta titanium alloy, for example, Ti-4.5Al-3V-2Fe-2Mo, Ti-4.5Al-2Mo-1.6V-0.5Fe-0.3Si-0.03C, Ti-1Fe-0.35O-0.01N, Ti-8Al-1Mo, Ti-5.5Al-1Fe, Ti-6Al-4V, Ti-6Al-6V-2Sn, Ti-6Al-2Sn-4Zr-6Mo, Ti-6Al-2Sn-4Zr-2Mo, Ti-8Al-1Mo-1V and the like can be used. Especially preferable are Ti-4.5Al-3V-2Fe-2Mo, Ti-4.5Al-2Mo-1.6V-0.5Fe-0.3Si-0.03C, and Ti-1Fe-0.35O-0.01N because workability is excellent though the specific tensile strength is high.

Figure 3:
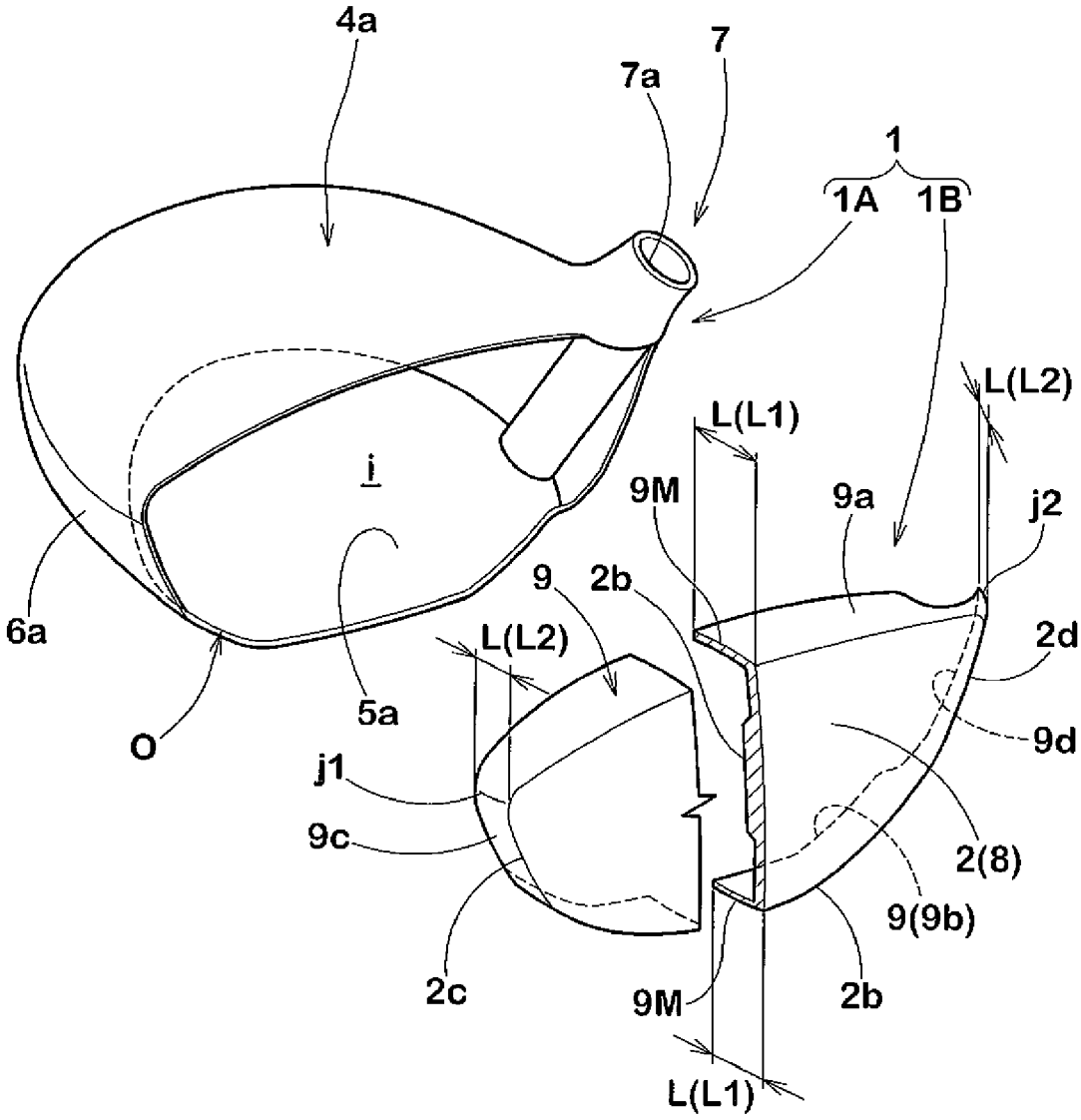
FIG. 3 is an exploded perspective view thereof.
Figure 4:
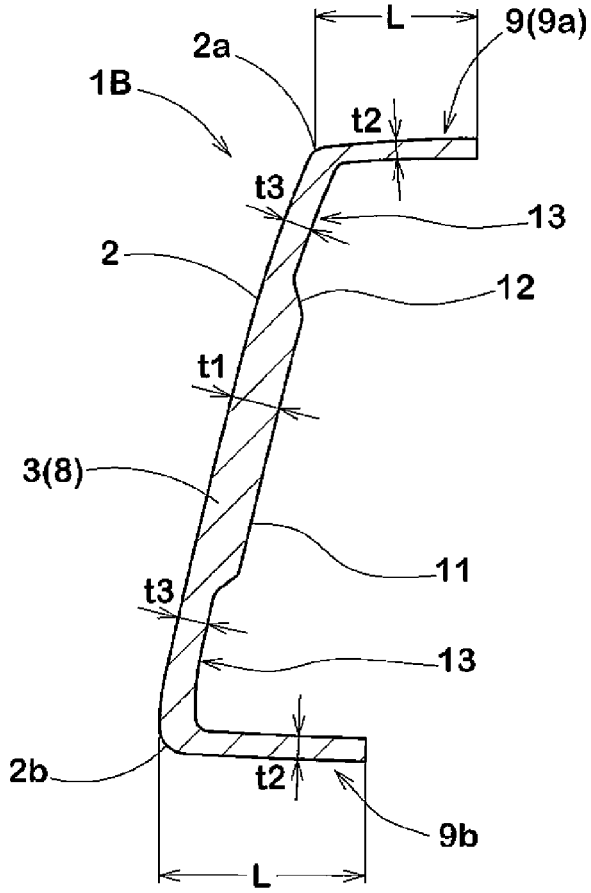
FIG. 4 is a cross section of the face member taken along line A-A in FIG. 2.
Figure 5:
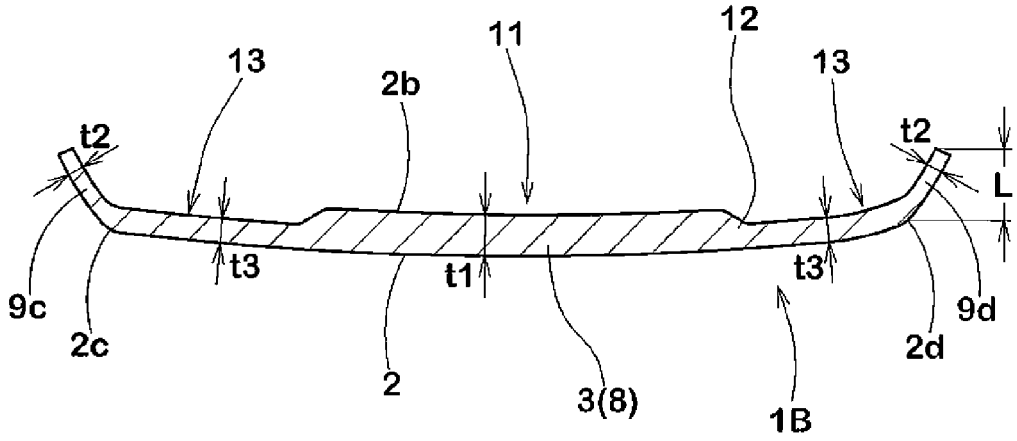
FIG. 5 is a cross section of the face member taken along line B-B in FIG. 2.

In this embodiment, as shown in FIG. 3, the face-plate 8 forms the entirety of the face portion 3. Thus, the front surface of the face-plate 8 forms the entirety of the club face 2.

The face-plate 8 comprises a central thick part 11 including the sweet spot SS, a thinner peripheral part 13, and a transitional part 12 therebetween.

The central thick part 11 has a shape similar to that of the club face 2 which is long in the toe-heel direction, and the sweet spot SS is substantially centered on the central thick part 11 as shown in FIG. 2.

The central thick part 11 has a thickness t1 which is largest in the face portion 3.

In this embodiment, the thickness t1 is substantially constant. Preferably, the thickness t1 is set in a range of not less than 2.90 mm, more preferably not less than 2.97 mm, still more preferably not less than 3.00 mm, especially preferably not less than 3.05 mm in order to provide sufficient durability for the face portion 3, but not more than 3.90 mm, more preferably not more than 3.85 mm, still more preferably not more than 3.75 mm in view of the coefficient of restitution of the face portion.

The thinner peripheral part 13 is formed around the central thick part 11 in order to improve the rebound performance of the club head and at the same time to reduce the weight of the face portion 3. In this embodiment, the thinner peripheral part 13 is formed continuously or annularly, and the thickness t3 is substantially constant and smallest in the face portion 3. Preferably, the thickness t3 is set in a range of not less than 1.50 mm, more preferably not less than 1.60 mm, still more preferably not less than 1.65 mm in view of the durability of the face portion 3, but not more than 2.50 mm, more preferably not more than 2.40 mm, still more preferably not more than 2.30 mm in view of the coefficient of restitution of the face portion.

In this embodiment, since the thicknesses t1 and t3 are substantially constant, the transitional part 12 is formed between the central thick part 11 and the thinner peripheral part 13, and the thickness thereof gradually continuously decreases from the central thick part 11 to the peripheral part 13 in order to prevent stress concentration and to improve the durability of the face portion. The transitional part 12 in this embodiment is formed continuously around the central thick part 11.

In FIG. 3, the above-mentioned turnback 9 is formed along the entire length of the edge of the face-plate 8. Accordingly, the turnback 9 includes: a crown-side turnback 9*a* extending backward from the upper edge 2*a* of the club face 2 to form a front part of the crown portion 4; a sole-side turnback 9*b* extending backward from the lower edge 2*b* of the club face 2 to form a front part of the sole portion 5; a toe-side turnback 9*c* extending backward from the toe-side edge 2*c* of the club face 2 to form a toe-side part of the side portion 6; and a heel-side turnback 9*d* extending backward from the heel-side edge 2*d* of the club face 2 to form a heel-side part of the side portion 6. It is desirable to form the turnback 9 along the entire length of the edge in order to keep the club face 2 as far away from the weld junction as possible.

If the thickness t2 of the turnback 9 is too small, it is difficult to provide necessary durability for the head. If the thickness t2 is too large, on the other hand, then the coefficient of restitution of the face portion is decreased, and crease and cracks tend to occur in the press working after-mentioned. In this light, the thickness t2 of the turnback 9 is preferably set in a range of not more than 2.50 mm, more preferably not more than 2.40 mm, still more preferably not more than 2.30 mm, especially preferably not more than 2.0 mm, but not less than 1.0 mm, more preferably not less than 1.10 mm, still more preferably not less than 1.15 mm.

The thickness t2 is smaller than the thickness t3 of the thinner peripheral part 13 in order to effectively increase the coefficient of restitution of the face portion.

The above-mentioned main body-member 1A forms the remained part of the club head 1 excepting the face member 1B. In this embodiment, accordingly, the main body-member 1A includes: a major aft part 4*a* of the crown portion 4; a major aft part 5*a* of the sole portion 5; a major aft part 6*a* of the side portion 6; and the above-mentioned hose 1 portion 7, and as a result, an opening O closed by the face member 1A is formed at the front thereof.

The main body-member 1A is mainly made of one or more kinds of metal materials. For example, stainless steel, maraging steel, titanium alloy, aluminum alloy, magnesium alloy and the like can be used for making the main body-member 1A. The main body-member 1A in this embodiment is made of one kind of metal material.

For the purpose of adjusting the position of the center of gravity of the head and the like, the main body-member 1A can include a nonmetal part made of for example fiber reinforced resin or the like having a relatively small specific gravity. Incidentally, it is possible to attach a separate weight member having a relatively large specific gravity to the main body-member 1A.

According to the present inventions the method for manufacturing the golf club head comprises the steps of: making the main body-member 1A; making the face member 1B; and welding the face member 1B to the main body-member 1A.

Accordingly, it is necessary that at least the part of the main body-member 1A to which the face member 1B is welded is made of a weldable metal material.

In this embodiment, the main body-member 1A is formed by casting one of the above-mentioned metal materials (preferably, lost-wax precision casting).

The method for making of the face member 1B comprises the following steps (a), (b), (c) and (d), and optionally steps (f) and (g).

*Step (a)

Figure 6:
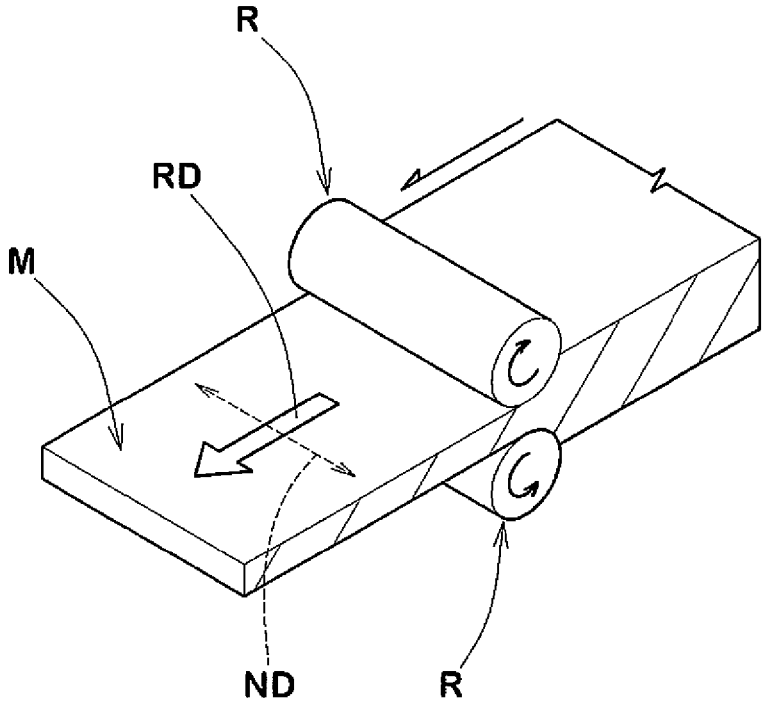
FIG. 6 is a schematic perspective view for explaining a step (a) of preparing the rolled material.

In the step (a), a rolled material M having a constant thickness is prepared. The rolled material M is a sheet metal obtained by passing a metal material through between rotating pressure rollers R, utilizing their friction as shown in FIG. 6.

Figure 7:
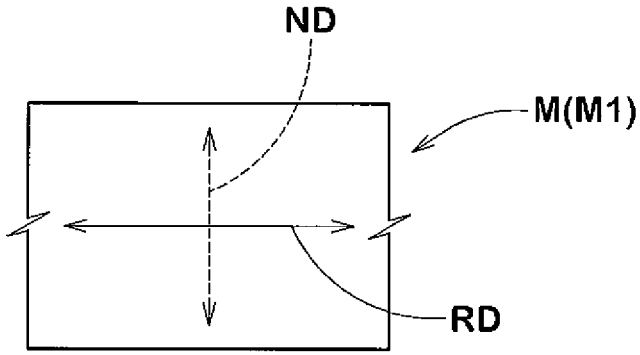
FIG. 7 is a plan view for explaining an unidirectionally rolled material.
Figure 8:
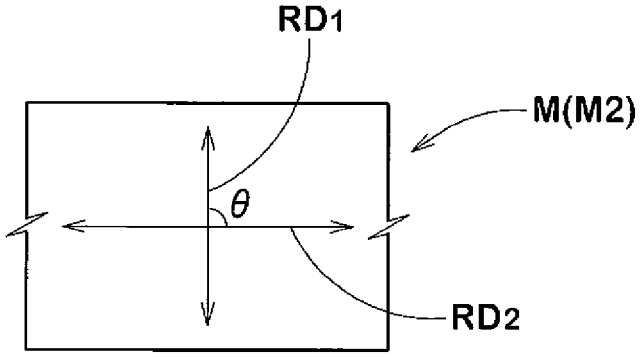
FIG. 8 is a plan view for explaining a multidirectionally rolled material.

In this invention, either a unidirectionally rolled material M1 or a multidirectionally rolled material M2 can be used for the face member 1B. The unidirectionally rolled material M1 means a sheet metal obtained by rolling the material a plurality of times in one direction RD as shown in FIG. 7. The multidirectionally rolled material M2 means a sheet metal obtained by rolling the material a plurality of times in at least two different directions RD1, RD2 - - - , as shown in FIG. 8.

In the case of the unidirectionally rolled material M1 made from a titanium alloy including alpha phase, the tensile elastic modulus and tensile strength in the rolling direction RD becomes smaller than those in the perpendicular direction ND thereto. Accordingly, if the rolled material M1 is bent along the rolling direction RD during the undermentioned press working in the step (c) for example, damage such as crack is liable to occur. Therefore, in order to lessen such strength anisotropy, the multidirectionally rolled material M2 is preferable to the unidirectionally rolled material M1. For example, a bidirectionally rolled material M2 of which rolling directions RD1 and RD2 intersect each other at an angle θ in a range of 70 to 90 degrees, preferably 80 to 90 degrees, more preferably 85 to 90 degrees (orthogonal rolling), can be used suitably for the multidirectionally rolled material M2.

*Step (b)

In the step (b), from the above-mentioned rolled material M, a blank 15 for the face member 1B is cut out, utilizing dies cutting, laser cutting or the like.

Figure 9:
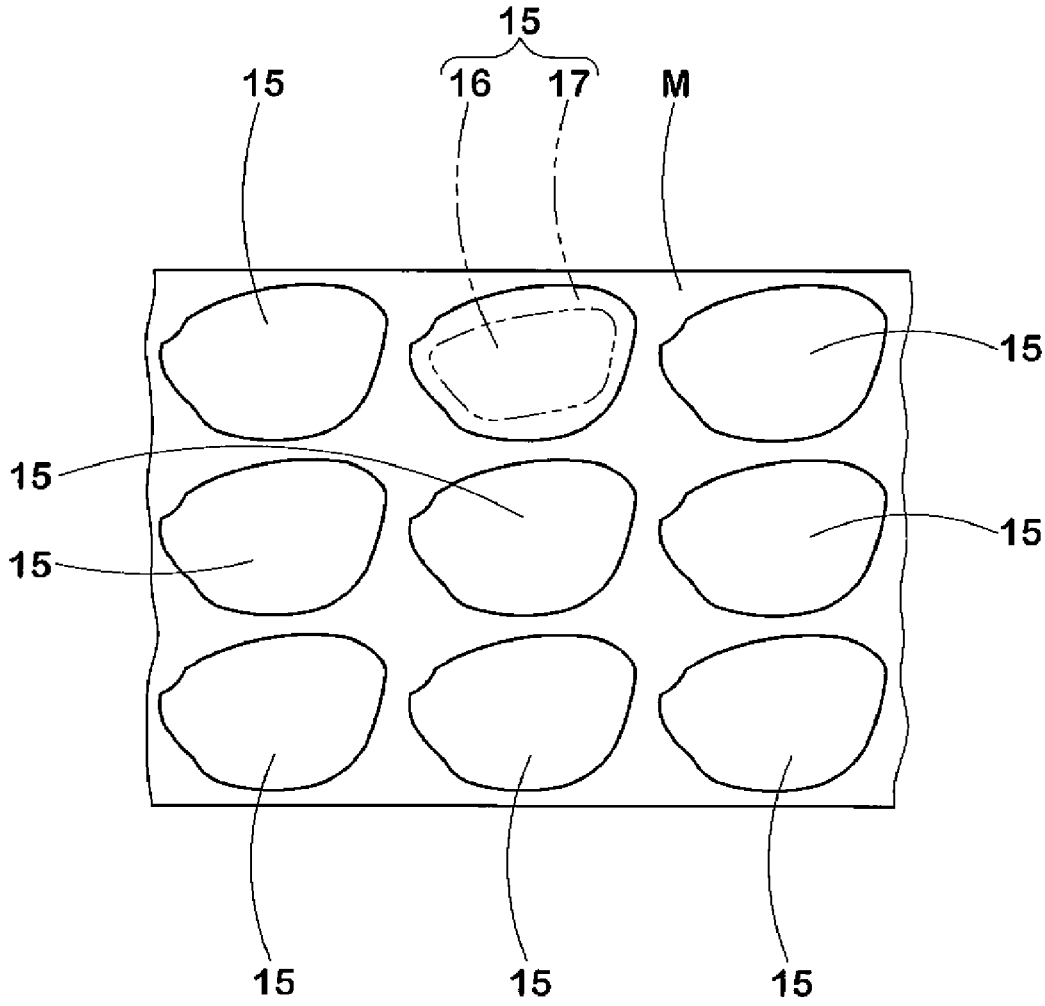
FIG. 9 is a plan view for explaining a step (b) of cutting out a blank for the face member from the rolled material.

FIG. 9 shows an example of the step (b), wherein a plurality of blanks 15 are cut out from the one rolled material M. The cutout blank 15 includes at least a corresponding-to-face-plate region 16 for forming the face-plate 8, and a corresponding-to-turnback region 17 for forming the turnback 9. Of course, necessary margins such as cutting stock can be further included.

*Step (c)

Figure 10:
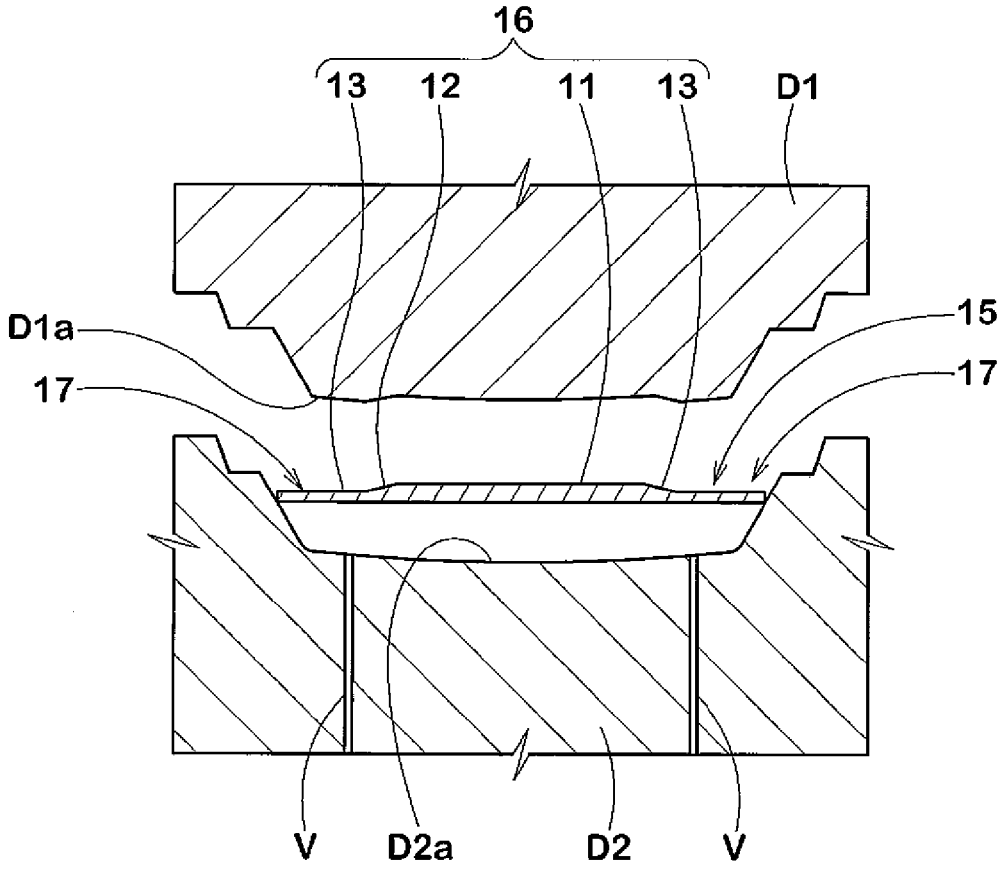
FIGS. 10 and 11 are cross sectional views for explaining a step (c) of forming the face member by press working.
Figure 11:
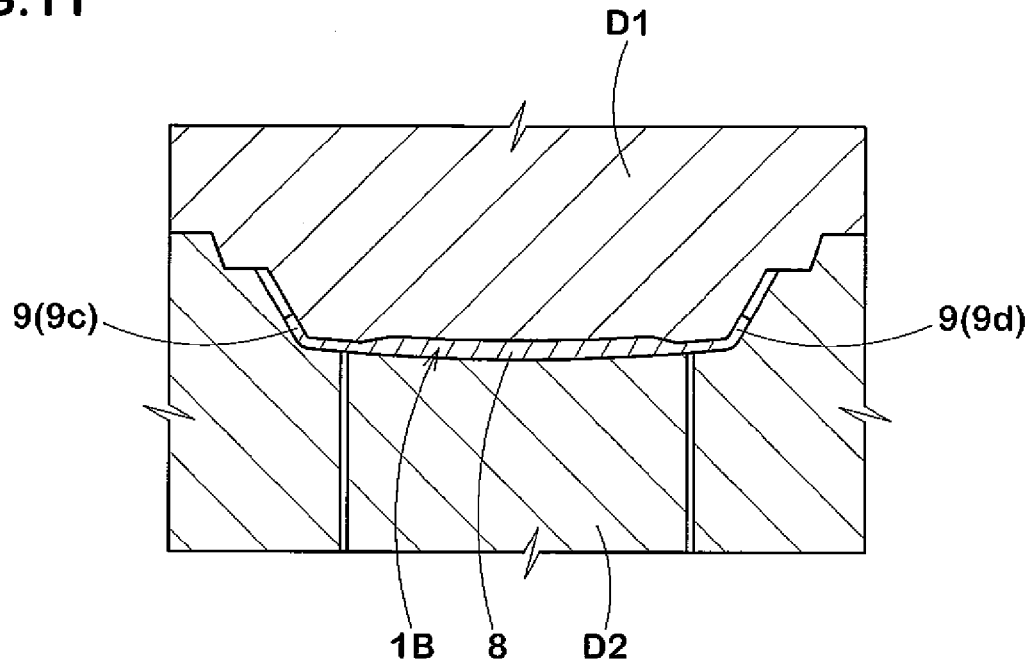

In the step (c), in order to obtain the face member 1B, the turnback 9 is formed on the blank 15 by press working, utilizing a male die D1 and a female die D2 as schematically shown in FIGS. 10 and 11. The female die D2 is provided with a concave shaping face D2*a* for shaping the outer surface of the face member 1B, and the shaping face is provided with vent holes V.

The male die D1 is provided with a convex shaping face D1*a* for shaping the inner surface of the face member 1B.

The blank 15 is first placed on the concave shaping face D2*a* of the female die D2 as shown in FIG. 10, and then shaped by pressing the male die D1 against the female die D2 as shown in FIG. 11, whereby the blank 15 causes a plastic deformation such that the above-mentioned corresponding-to-turnback region 17 is turned backward of the club head and as a result, the face member 1B is formed. Incidentally, it is possible to complete the press working by a single press operation or multiple press operations.

Figure 14:
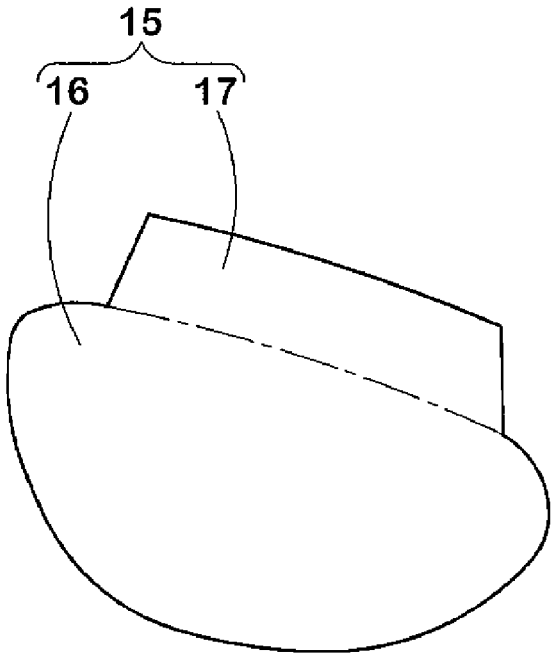
FIGS. 14 and 15 are a plan view and a perspective view, respectively, of another example of the face member.
Figure 15:
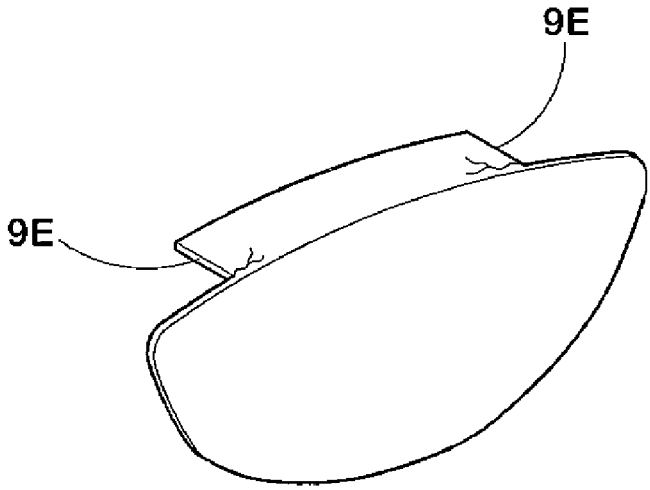
Figure 16:
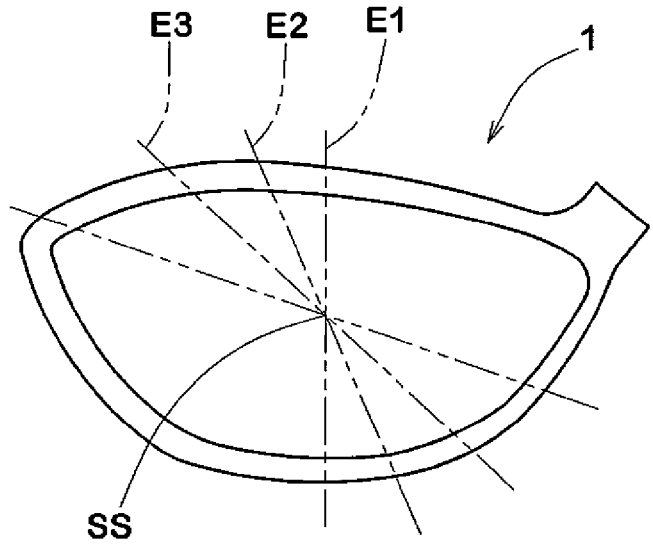
FIGS. 16 and 17 are a front view and a cross sectional view, respectively, for explaining the edge of the club face.
Figure 17:
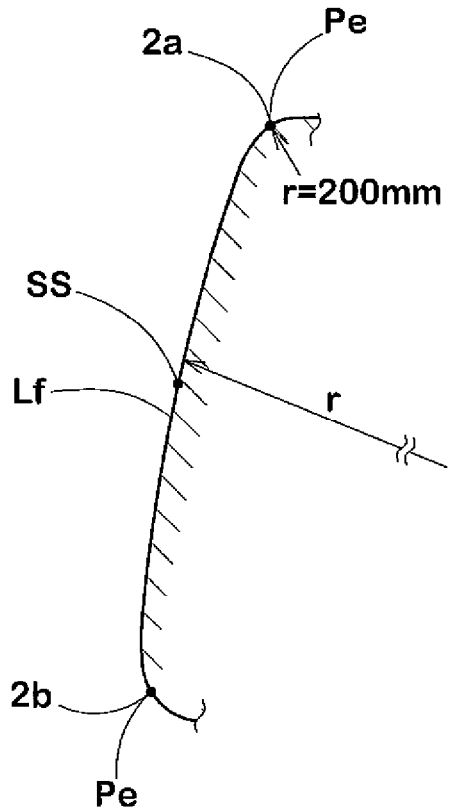
Figure 18:
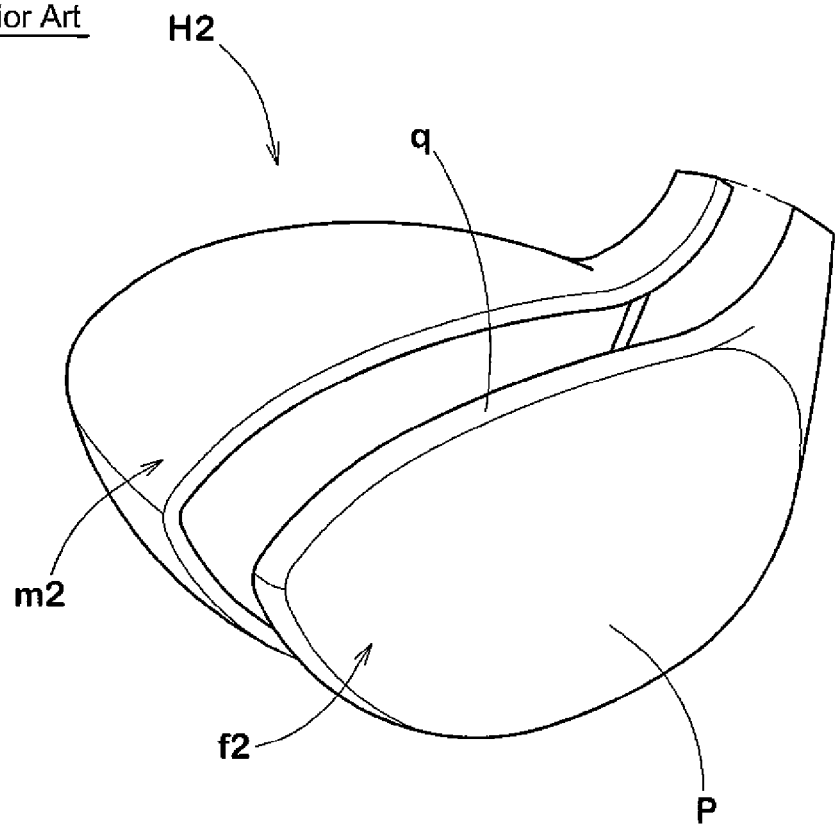
FIG.18 Prior Art
FIGS. 18 and 19 are an exploded perspective view and a cross sectional view showing a prior art hollow golf club head.
Figure 19:
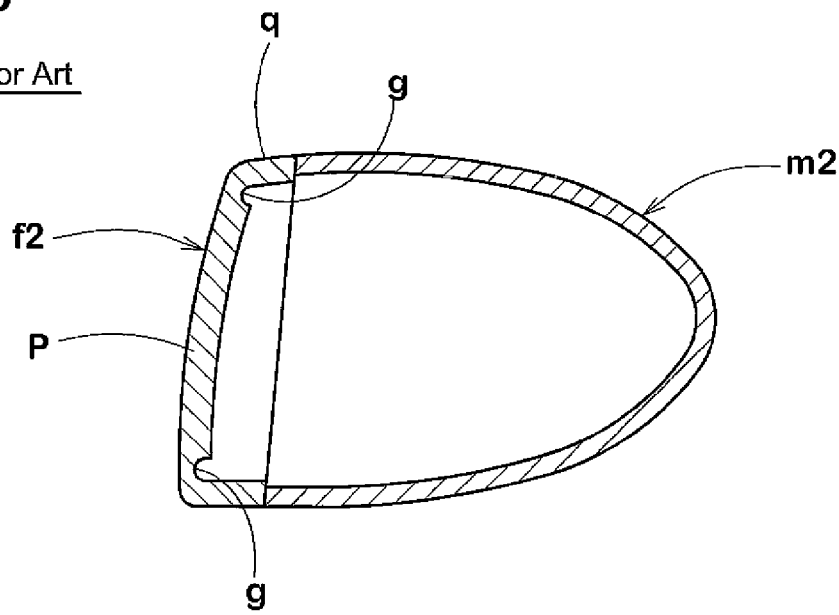
FIG.19 Prior Art

In this step (c), the corresponding-to-turnback region 17 is turned about 90 degrees during press working. Therefore, if the blank 15 does not include the corresponding-to-turnback region 17 formed continuously around the corresponding-to-face-plate region 16 as shown in FIG. 14, then there is a tendency that the stress concentrates at the corners 9E between the side edges of the turnback 9 and the peripheral edge of the face-plate 8, and cracks occur in the worst case as shown in FIG. 15. In contrast, when the corresponding-to-turnback region 17 is formed continuously around the corresponding-to-face-plate region 16 as shown in FIG. 9, the occurrence of such damage is reduced, therefore, it is preferable that the corresponding-to-turnback region 17 is formed continuously as far as possible.

It is preferable that the length L of the turnback 9 is increased in the crown-side turnback 9*a* and sole-side turnback 9*b* than the toe-side turnback 9*c* and heel-side turnback 9*d* in order to keep the weld junction away from the center of the face portion since the height of the face portion in the vertical direction is smaller than the width of the face portion in the toe-heel direction. Thus, the length L of each of the toe-side turnback 9*c* and heel-side turnback 9*d* can be made smaller when compared with the crown-side turnback 9*a* and sole-side turnback 9*b*. Here, the length of the turnback 9 is defined as being measured in the front-back direction of the club head from the edge (2*a*-2*d*) of the club face 2 to the rear edge of the turnback 9. In this embodiment, the length L of each of the crown-side turnback 9*a* and sole-side turnback 9*b* has its maximum value L1 in the middle position 9M in the toe-heel direction, and the length L gradually decreases toward the toe and heel. In the meantime, the pressure required to form the turnback 9 by press working becomes increased with the increase in the length L of the turnback 9, and the equipment cost and production cost tend to increase. In view of the above, the maximum length L1 of the turnback 9 is preferably set in a range of not less than 5.0 mm, more preferably not less than 7.0 mm, still more preferably not less than 8.5 mm, but not more than 15.0 mm, more preferably not more than 13.0 mm, still more preferably not more than 12.0 mm. If the maximum length L1 is too small, then there is the possibility that the rebound performance of the club head is decreased since the relatively rigid weld junction between the face member 1B and main body-member 1A comes near the club face 2. If the maximum length L1 is too large, on the other hand, then due to springback after the press working, the shaping accuracy is liable to deteriorate. On the other hand, in the corner j1 between the crown-side turnback 9*a* and toe-side turnback 9*c* and the corner j2 between the crown-side turnback 9*a* and heel-side turnback 9*d* as shown in FIG. 3, plastic deformation during press working becomes larger and the deformation is not simple, therefore damage is liable to occur. Therefore, in order to avoid such drawbacks, the length L is preferably decreased to a value L2 not more than ½ of the maximum length L1 in the vicinity of the corners j1 and 32. In this embodiment, the length L of each of the crown-side turnback 9*a* and heel-side turnback 9*d* is not more than ½ of the maximum length L1.

*Step (d)

Figure 12:
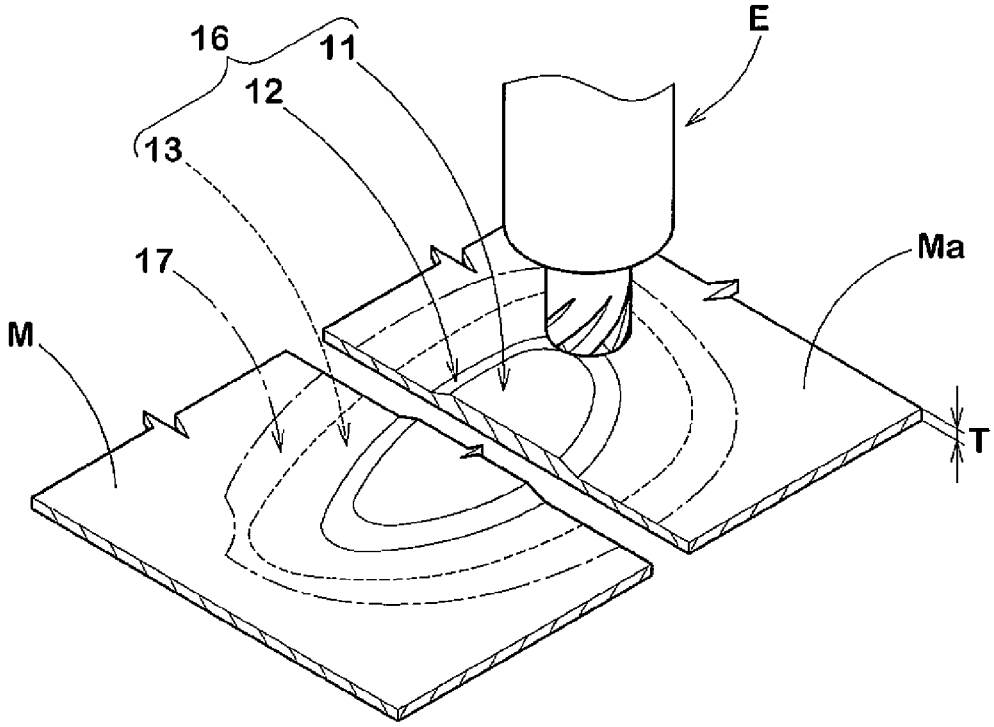
FIGS. 12 and 13 are perspective views for explaining a step (d) of reducing the thickness of of the region corresponding to the turnback.
Figure 13:
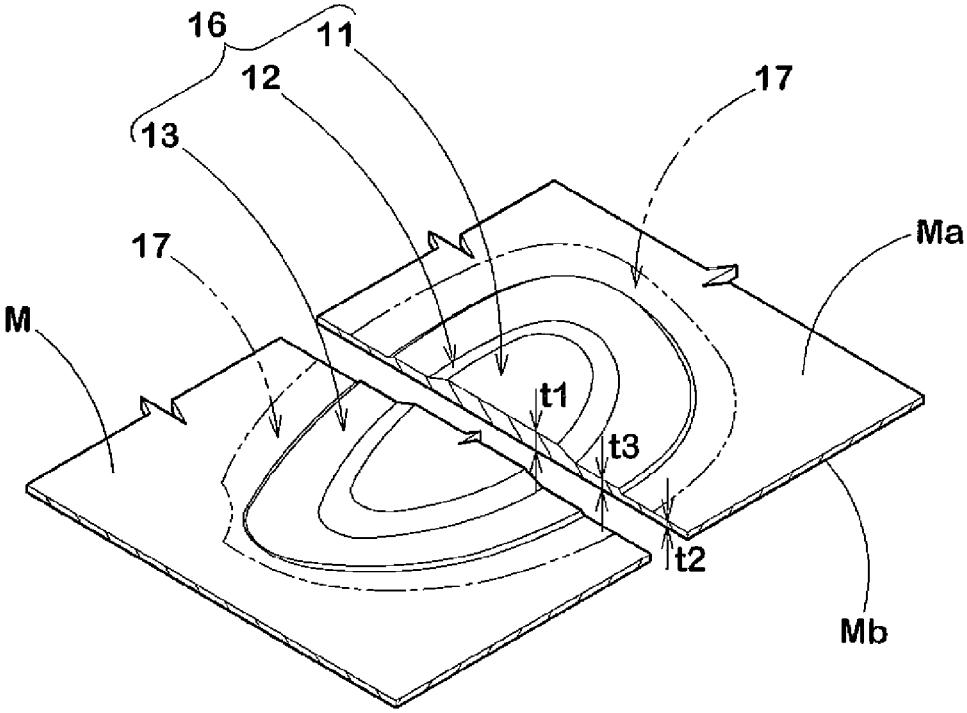

This step (d) has to be carried out after the step (a) and before the step (c). In the step (d), the above-mentioned corresponding-to-turnback region 17 is reduced in the thickness in the state of the cutout blank 15 (between the steps (b) and (c)), or in the state of the rolled material M (between the steps (a) and (b)) as shown in FIG. 12. In view of the production efficiency, it is preferred that this step (d) is carried out between the steps (a) and (b), namely, in the state of the rolled material M.

In order to reduce the thickness, machining is utilized. Here, the machining is meant for peripheral milling, face milling, and grinding.

For example, as schematically shown in FIG. 12, the rolled material M fixed to a stage of a milling machine (not shown) and a surface Ma thereof is cut by cutting edges E of an end mill (face mill) or the like. Preferably used as the milling machine is, for example, a multi-axis (three to five axis) NC machining system controlled by a computer according to the previously stored program.

By reducing the thickness, the corresponding-to-turnback region 17 becomes easy to deform during press working in the step (c), and thereby the turnback 9 can be formed by pressure molding without causing molding crease and cracks.

On the other hand, in order to secure sufficient durability of the face-plate 8 for hitting the ball, the corresponding-to-face-plate region 16 is left un-machined, or even if machined, the thickness of the corresponding-to-face-plate region 16 is set to be more than that of the corresponding-to-turnback region 17.

In this embodiment, by the machining in the step (d), the above-mentioned thinner peripheral part 13, thickness transitional part 12, and central thick part 11 are formed in the corresponding-to-face-plate region 16 of the rolled material M. The thickness t1 of the central thick part 11 is substantially same as the thickness T of the rolled material M.

As shown in FIG. 10, the above-mentioned male die D1 is provided with a complementary pattern of the pattern formed by the parts 11, 12 and 13. This facilitates the positioning of the blank 15 relative to the male die D1 and can prevent displacement of the blank 15 due to the pushing motion of the male die D1 during press working.

*Step (e)

This step (e) is to reduce or remove the strength anisotropy from the rolled material M or the blank 15.

Usually, unidirectionally rolled materials have large strength anisotropy as well know in the art. Further, even in multidirectionally rolled materials M2, strength anisotropy resides more or less.

If the ratio (Smax/Smin) of the maximum tensile strength Smax occurring in any direction and the minimum tensile strength Smin occurring in another direction is more than 1.20, then it is desirable to further include the following step (e1, e2) as the step (e) in order to reduce the residual anisotropy such that the ratio (Smax/Smin) becomes not more than 1.20, preferably not more than 1.15, more preferably not more than 1.10 when subjected to the press working in the step (c).

*Step (e1) of Additional Rolling

This step (e1) is suitably applied to the unidirectionally rolled material M1 before cutting out the blank(s) 15, wherein the rolled material M1 is further rolled along the normal direction ND to the final rolling direction RD, usually one or two times, so that the reduction ratio becomes in a range of from 5 to 10%. Here, the reduction ratio (%) is $\{(h1-h2)/h1\}\times 100$, wherein h1 is the thickness before rolled, and h2 is the thickness after rolled. This step (e1) can be included between the steps (a) and (b).

*Step (e2) of Heat Treating

This step (e2) is advantageously applied to the face member 1B made from alpha-beta titanium alloy.

In this step (e2), the alpha-beta titanium alloy in the state of the rolled material M, the cutout blank 15 or the finished face member 1B, is heated at a temperature of not more than the beta transformation temperature of the titanium alloy, for example, heated in a temperature range between 700 and 800 degs.C., for 30 to 60 minutes and then slow cooled down.

In the case of the unidirectionally rolled material M1, it is preferable that, through the step (e1 and/or e2), the ratio (S2/S1) of the tensile strength S1 in the rolling direction RD and the tensile strength S2 in the normal direction ND is reduced to a value in a range of not more than 1.20, preferably not more than 1.15, more preferably not more than 1.10, to thereby prevent the damage during press working.

*Step (f)

This step (f) is to cause face bulge/roll.

The face bulge and/or roll can be formed during the press working in the step (c) by the use of the above-mentioned dies D1 and D2, or during the cutout working in the step (b) by the use of blanking dies. Thus, this step (f) can be incorporated in the step (c) or (b). But, it is also possible to include this step (f) as an independent step before the undermentioned step (g).

*Step (g)

In this step (g), the face member 1B is fixed to the main body-member 1A by welding the rear edge of the turnback 9 to the front edge of the main body-member 1A around the opening o. Preferably, Tig welding, plasma-arc welding, or laser welding can be used, but soldering can be used too. In this invention, the meaning of the term "welding" is expanded so as to include "soldering". Most preferably, laser welding or plasma welding is used because the dispersion of heat can be minimized and a high joint strength can be obtained.

Comparison Tests

Face members shown in Tables 1 and 2 were manufactured and welded to identical main body-members to form wood-type golf club heads (volume 460 cc, Loft 11.5 degs., Lie 57.5 degs.), and the yielding percentage of each of the face members was obtained. The main body-member was formed by lost-wax precision casting of Ti-6Al-4V. The face member was fixed to the main body-member, using plasma welding. The Step (f) of causing the face bulge and roll was incorporated into the step (c).

In the step (e1) of additional rolling carried out in Ex.8, the unidirectionally rolled material M1 before cutting out the blanks 15 was further rolled along the normal direction ND to the final rolling direction RD twice so that the reduction ratio became 10%.

In the step (e2) of heat treating carried out in Ex.6 and EX.9, the cutout blank 15 was heated at 830 deg.C. for 30 minutes and then slow cooled.

The yielding percentage of each face member was obtained from thirty samples manufactured. The larger value is better. The samples of the face members count as defective products include: the face member was broken during press working; cracks were occurred on the turnback; the length of the turnback was largely varied more than 1 mm from the standard designed value; and the turnback could not fit to the opening of the main body-member.

The test results are shown in Table 1.

TABLE 1

| Face member | Ex. 1 | Ex. 2 | Ex. 3 | Ex. 4 | Ex. 5 | Ex. 7 | Ex. 8 | Ex. 6 | Ex. 9 | Ref. 1 | Ex. 10 | Ex. 11 |
|---|---|---|---|---|---|---|---|---|---|---|---|---|
| Rolled material (Table 2) | C | C | C | C | A | C | C | B | C | C | C | C |
| Order of Step | | | | | | | | | | | | |
| 1st | (a) | (a) | (a) | (a) | (a) | (a) | (a) | (a) | (a) | (a) | (a) | (a) |
| 2nd | (d) | (d) | (d) | (d) | (d) | (b) | (e1) | (d) | (d) | (b) | (d) | (d) |
| 3rd | (b) | (b) | (b) | (b) | (b) | (d) | (d) | (b) | (b) | (c) | (b) | (b) |
| 4th | (c) | (c) | (c) | (c) | (c) | (c) | (b) | (e2) | (e2) | (d) | (c) | (c) |
| 5th | — | — | — | — | — | — | (c) | (c) | (c) | — | — | — |
| Length L of Turnback | | | | | | | | | | | | |
| Crown-side (mm) | 10 | 10 | 10 | 10 | 5 | 10 | 10 | 7 | 10 | 10 | 7 | 10 |
| Sole-side (mm) | 10 | 10 | 10 | 10 | 5 | 10 | 10 | 7 | 10 | 10 | 7 | 10 |
| Toe-side (mm) | 5 | 3 | 7 | 5 | 3 | 5 | 5 | 3 | 5 | 5 | 7 | 7 |
| Heel-side (mm) | 3 | 3 | 3 | 5 | 3 | 3 | 3 | 3 | 3 | 3 | 7 | 7 |
| Maximum thickness t1 of central part (mm) | 3.28 | 3.37 | 3.55 | 3.52 | 3.45 | 3.39 | 3.54 | 3.5 | 3.43 | 3.7 | 3.47 | 3.45 |
| Minimum thickness t3 of peripheral part (mm) | 1.86 | 2.05 | 2.17 | 2.24 | 2.45 | 2.35 | 2.13 | 2.15 | 2.31 | 3.7 | 2.25 | 2.31 |
| Thickness t2 of Turnback | | | | | | | | | | | | |
| maximum (mm) | 1.45 | 1.4 | 1.35 | 1.43 | 1.38 | 1.44 | 1.4 | 1.3 | 1.35 | 3.7 | 1.46 | 1.41 |
| minimum (mm) | 0.95 | 1.05 | 1.02 | 0.98 | 1.05 | 1.08 | 0.92 | 0.91 | 0.99 | 3.7 | 1.1 | 1.02 |
| Tensile strength | | | | | | | | | | | | |
| S2/S1 of Rolled material | — | — | — | — | — | — | 1.32 | 1.21 | 1.32 | — | — | — |
| Smax/Smin after step (e1 or e2) | — | — | — | — | — | — | 1.03 | 1.01 | 1.03 | — | — | — |
| Yielding (%) | 95 | 98 | 85 | 88 | 95 | 94 | 100 | 96 | 100 | 0 | 78 | 75 |

TABLE 2

| | Rolled material | | |
|---|---|---|---|
| | A | B | C |
| Composition | Ti—6Al—4V | Ti—4.5Al—2Mo—1.6V—0.5Fe—0.3Si—0.03C | Ti—4.5Al—3V—2Fe—2Mo |
| Thickness (mm) | 3.6 | 4.0 | 3.7 |
| Rolling | unidirectional | unidirectional | unidirectional |

The invention claimed is:

1. A method for manufacturing a golf club head having a hollow structure composed of a main body-member and a metal face member welded to the main body-member, the metal face member integrally including a face-plate and a turnback, the face-plate having a rear surface and a front surface forming a club face, the face-plate comprising a central thick part and a thinner peripheral part therearound, and the turnback extending backward from at least part of the edge of the club face, the method comprising:

step (a) of preparing a rolled material having a constant thickness;

step (b) of cutting out a face member part from the rolled material;

step (c) of making the face member by forming the turnback through press working on the face member part; and step (d) of machining the cutout face member part after the step (b) and prior to the step (c) to reduce the thickness of a corresponding-to-turnback region and a part of a corresponding-to-face-plate region, wherein the corresponding-to-turnback region is a region of the cutout face member part corresponding to the turnback, and the part of the corresponding-to-face-plate region is a region of the cutout face member part corresponding to the thinner peripheral part of the face-plate, wherein the machining is carried out on a flat surface of the cutout face member part corresponding to the rear surface of the face-plate, and wherein, the method further comprises, prior to the step (c), a step of heat treating the cutout face member part by heating the cutout face member part in a temperature ranging between 700 and 800° C., for 30 to 60 minutes and then slowly cooling down.

2. The method according to claim 1, wherein the turnback is formed along the substantially entire length of the edge of the face-plate.

3. The method according to claim 2, wherein the turnback includes a crown-side turnback, a sole-side turnback, a toe-side turnback and a heel-side turnback, and each of the maximum length of the toe-side turnback and the maximum length of the heel-side turnback is not more than 50% of the maximum length of the crown-side turnback and not more than 50% of the maximum length of the sole-side turnback.

4. The method according to claim 1, wherein the rolled material is multidirectionally rolled in at least two different rolling directions, the intersecting angle between which is in a range of from 70 to 90 degrees.

5. The method according to claim 1, wherein the thickness of the face-plate is not less than 3.0 mm, and the thickness of the turnback is not more than 2.0 mm.

6. The method according to claim 1, wherein in the step (b), a plural number of the face member parts are cut out from the rolled material.

7. A method for manufacturing a golf club head having a hollow structure composed of a main body-member and a metal face member welded to the main body-member, the metal face member integrally including a face-plate and a turnback, the face-plate having a rear surface and a front surface forming a club face, the face-plate comprising a central thick part and a thinner peripheral part therearound, and the turnback extending backward from at least part of the edge of the club face, the method comprising:

step (a) of preparing a rolled material having a constant thickness;

step (b) of cutting out a face member part from the rolled material;

step (c) of making the face member by forming the turnback through press working on the face member part; and step (d) of machining the rolled material prior to the step (b) to reduce the thickness of a corresponding-to-turnback region and a part of a corresponding-to-face-plate region, wherein the corresponding-to-turnback region is a region of the rolled material corresponding to the turnback, and the part of the corresponding-to-face-plate region is a region of the rolled material corresponding to the thinner peripheral part of the face-plate, wherein the machining is carried out on a flat surface of the rolled material corresponding to the rear surface of the face-plate, and wherein, the method further comprises, prior to the step (c), a step of heat treating the cutout face member part by heating the cutout face member part in a temperature ranging between 700 and 800° C., for 30 to 60 minutes and then slowly cooling down.

8. The method according to claim 7, wherein the turnback is formed along the substantially entire length of the edge of the face-plate.

9. The method according to claim 8, wherein the turnback includes a crown-side turnback, a sole-side turnback, a toe-side turnback and a heel-side turnback, and each of the maximum length of the toe-side turnback and the maximum length of the heel-side turnback is not more than 50% of the maximum length of the crown-side turnback and not more than 50% of the maximum length of the sole-side turnback.

10. The method according to claim 7, wherein the rolled material is multidirectionally rolled in at least two different rolling directions, the intersecting angle between which is in a range of from 70 to 90 degrees.

11. The method according to claim 7, wherein the thickness of the central thick part of the face-plate is not less than 3.0 mm, and the thickness of the turnback is not more than 2.0 mm.

12. The method according to claim 7, wherein in the step (b), a plural number of the face member parts are cut out from the rolled material.

* * * * *